United States Patent [19]

Yang

[11] Patent Number: 4,580,418

[45] Date of Patent: Apr. 8, 1986

[54] OSCILLATION DAMPING AND COUNTERPOISING CIRCULAR KNITTING MACHINE

[76] Inventor: Ping-Chin Yang, No. 6, Alley 1, Lane 219, Tsu-Chiang S. Rd., Kwei San, Tao Yuang, Taiwan

[21] Appl. No.: 628,440

[22] Filed: Jul. 6, 1984

Related U.S. Application Data

[60] Division of Ser. No. 307,422, Oct. 1, 1981, Pat. No. 4,458,507, which is a continuation-in-part of Ser. No. 205,254, Nov. 10, 1980, abandoned, which is a division of Ser. No. 934,612, Aug. 17, 1978, Pat. No. 4,261,187.

[51] Int. Cl.[4] ..... D04B 9/06; D04B 35/34

[52] U.S. Cl. ..... 66/28; 66/147

[58] Field of Search ..... 66/8, 19, 28, 147, 149 R, 66/151, 153

[56] References Cited

U.S. PATENT DOCUMENTS

| | | | |
|---|---|---|---|
| 3,222,889 | 12/1965 | Mishcon | 66/28 |
| 3,521,466 | 7/1970 | Tannert | 66/19 |
| 3,525,240 | 8/1970 | Piana et al. | 66/147 |

FOREIGN PATENT DOCUMENTS

| | | | |
|---|---|---|---|
| 51-102152 | 9/1976 | Japan | 66/151 |
| 1826 | of 1858 | United Kingdom | 66/8 |

*Primary Examiner*—Wm. Carter Reynolds

*Attorney, Agent, or Firm*—Shoemaker and Mattare, Ltd.

[57] ABSTRACT

An oscillation damping and counterpoising circular knitting machine having a base, a machine truss fixedly mounted on the base, and a first machine plate fixedly mounted on the generally middle portion of the machine truss. A latch needle holder rotatably supported by the first machine plate has a circumference on which a plurality of latch needles are provided. A plurality of cams are disposed around the latch needles for effecting a knitting operation when the latch needle holder is rotated. Driving structure causes the latch needle holder to rotate, the driving structure including a first bracket member and a second bracket member with the first bracket member being operatively connected to the second bracket member by pin members having one end fixed on the first bracket member and another end loosely inserted into a slot formed on the second bracket member to allow self-alignment of the first bracket member with the second bracket member. A gear member is fixedly connected to the second bracket member and is driven by a motor driven pinion.

6 Claims, 12 Drawing Figures

OSCILLATION DAMPING AND COUNTERPOISING CIRCULAR KNITTING MACHINE

CROSS-REFERENCE TO RELATED APPLICATIONS

This is a division of application Ser. No. 307,422, filed Oct. 1, 1981, now U.S. Pat. No. 4,458,507. Application Ser. No. 307,422 (now U.S. Pat. No. 4,458,507) is a continuation-in-part of application Ser. No. 205,254 filed Nov. 10, 1980, now abandoned which is a divisional application of the application Ser. No. 934,612 filed Aug. 17, 1978, now U.S. Pat. No. 4,261,187 issued Apr. 14, 1981.

BACKGROUND OF THE INVENTION

Generally, conventional circular knitting machines employ a driving pinion to engage with a ring gear integrally formed with or mounted onto a latch needle cylinder having thereon latch needles to perform the knitting operation. Due to the clearance between the teeth of the pinion and those of the ring gear, an oscillation will certainly occur at the point the ring gear and pinoin are engaged. Each time any of the latch needles rotates to the position where it is relatively close to the point of engagement i.e., the oscillation source, the oscillation will grow, while each time any of the latch needles rotates to the position where it is relatively far from the oscillation source, the oscillation decreases. This uneven oscillation leads to the occurrence of undesirable horizontal lines on the knitted fabric. Aside from such an uneven oscillation, there are of course still other causes, such as the uneven quality of yarns, mis-adjustment of cams, etc., which will also create the undesirable horizontal lines. Nevertheless, these other causes may be more easily controlled than the uneven oxcillation and have been controlled in actual practice. To prove that the undesirable horizontal lines arise from the uneven oscillation, the inventor has made an experiment with a circular knitting machine of 38 gauge. In the experiment dye was smeared on the yarn entrance of the transmission assembly which was closest to the oscillation source, i.e., the engagement point between a gear wheel and a pinion so that when the yarn entered, the dye marked the yarn. The resulting knitted fabric revealed a dyed track on thick horizontal lines thereof. The same experiment was repeated at another transmission assembly opposite the first transmission assembly, and the dyed track was again seen on thin horizontal lines thereof. To obtain a further proof thereof, the inventor removed the second mentioned transmission assembly and found that the thin horizontal lines disappeared. Therefore, it has been concluded that the greater the source of oscillation of the latch needles the denser will be the undesirable horizontal lines.

SUMMARY OF THE INVENTION

This invention discloses a circular knitting machine comprising a machine truss, a machine plate fixedly mounted onto the machine truss, and a latch needle holder rotatably supported by the machine plate, the latch needle holder having thereon a plurality of latch needles to perform the knitting operation. The latch needle holder is driven for rotation by a driving device including a gear wheel in mesh with a pinion driven by an electric motor, in which the gear wheel is separated from the portion of the latch needle holder where latch needles are provided so that the oscillation created by the gear wheel and pinion is dispersed before reaching the latch needles.

The circular knitting machine of this invention may be of a single knitting type having one group of latch needles on one latch needle holder that may be in the form of a cylinder or a circular plate, or of a double knitting type having another group of latch needles on another latch needle plate disposed above the first latch needle holder to cooperate with the first group of latch needles on the first latch needle holder.

DETAILED DESCRIPTION OF THE INVENTION

Figure 1:
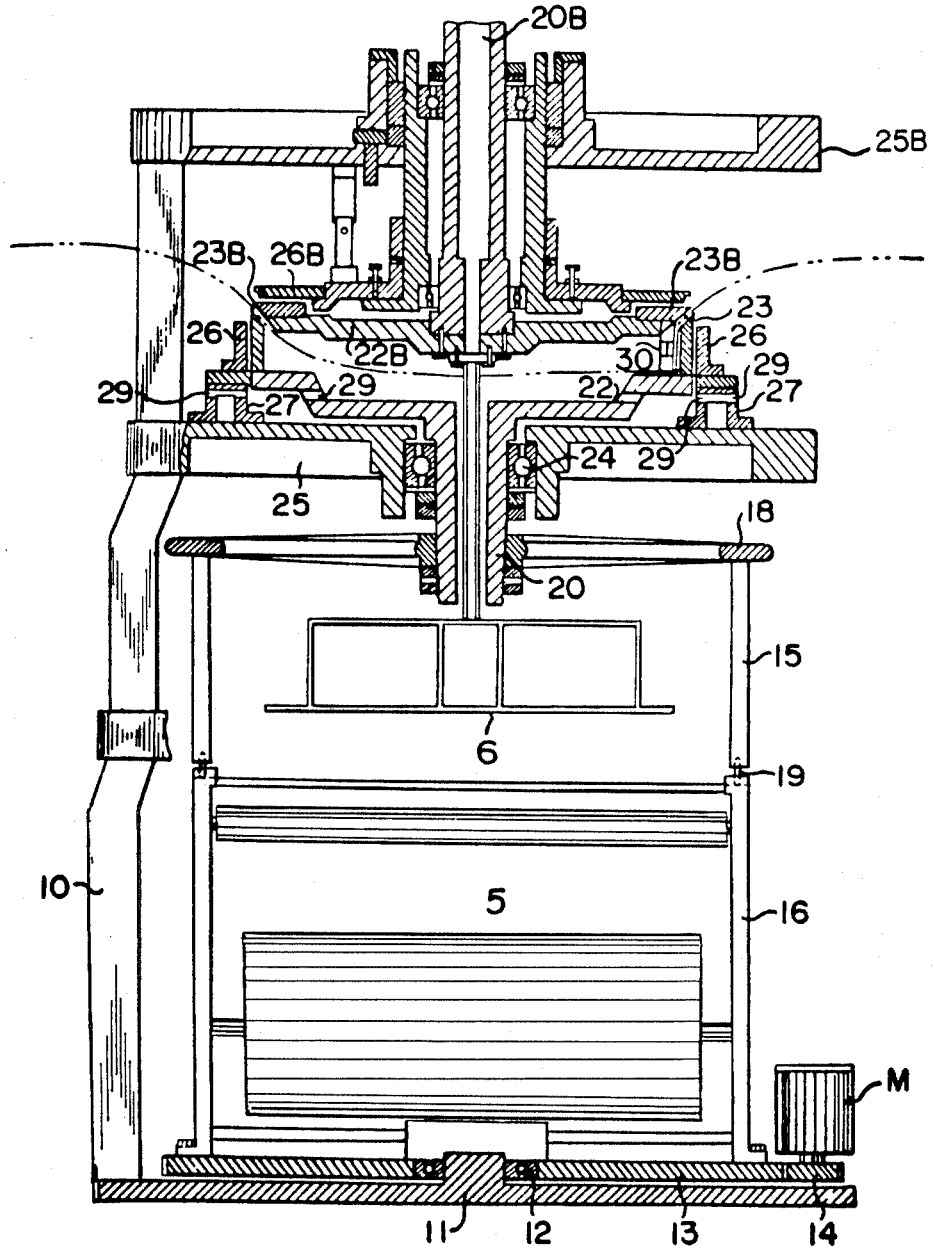
FIG. 1 is a longitudinal cross-sectional view of first and second embodiments of the invention wherein the former is the portions under the phantom line, while the later includes the portion under and above the phantom line.

In FIG. 1, the portion under the phantom line is a single circular knitting machine with a single shaft, being a first embodiment of the invention. Upon base 11 of machine truss 10, gear wheel 13 is rotatably mounted with bearing 12. The gear wheel 13 is in mesh with pinion 14 so that when driven by motor M, the pinoin 14 will drive the gear wheel 13 to rotate. Upon gear wheel 13, there are provided an upper driving bracket 15 and a lower driving bracket 16, both being connected together by means of movable pins 19. Also as shown in FIG. 1, the upper driving bracket 15 is fixed beneath transmission ring 18, while the lower driving bracket 16 is fixed onto gear wheel 13. Cloth take-up roll 5 is rotatably mounted on lower driving bracket 16. When said gear wheel 13 is driven, transmission ring 18 will rotate by means of the transmission of the upper and lower driving brackets whereby central hollow shaft 20 fixed onto the transmission ring 18 will rotate on the heels thereof. The shaft 20 thus forms an active central hollow shaft. Horizontally upon central hollow shaft 20 is secured a latch needle holder or a circular latch needle plate 22 having a rim and a lower hub, and the outer circumference thereof is provided a plurality of latch needles 23. Between the rim and the lower hub of circular latch needle plate 22, there is further provided an inspection space 29. The central hollow shaft 20 is rotatably supported by circular machine plate 25 by means of bearing 24, the circular machine plate 25 being fixed onto the machine truss 10. In abutment with the rim of circular machine plate 25, cams 26 are provided. Between cams 26 and latch needle plate 22, inspection space 29 is provided. It is noted in FIG. 1 that one inspection space 29 is defined between the lower hub and the rim of the circular latch needle plate 22 and other spaces between the cams 26 and cam seats 27. Therefore, taking advantage of a plurality of inspection spaces 29 which are formed in pairs, the operator can check the status of cloth inside the knitting machine. When circular latch needle plate 22 is driven to rotate, cams 26 will coordinate therewith to perform the knitting. From above, it is easily seen that gear wheel 13 and pinion 14 are located at the bottom of the machine and that the oscillation occurring between gear wheel 13 and pinion 14 travels a long distance successively through lower driving bracket 16, upper driving bracket 15, central hollow shaft 20, and further circular latch needle plate 22 to the tips of latch needles 23 where the magnitude of oscillation is reduced to the smallest. Besides, when the oscillation reaches central hollow shaft 20, it can be radially and evenly distributed to the latch needles whereby the equal magnitude of oscillation thereupon can obviate the occurrence of the undesirable horizontal lines.

The fabric is drawn through latch needles 23 and 23B whereby the fabric is being knitted into a cloth of cylindrical shape, which is gathered and drawn through the hollow space around a rod in shaft 20 to the take up roll 5 below, the rod being fixed to the lower, central portion of latch needle plate 22B and provided with a fabric stretcher 6 at its lower end, and with stretcher 6 the cloth drawn through the central hollow space in shaft 20 is stretched for winding by take-up roll 5. The size of the central hollow shaft 20 depends upon the thickness of the cloth to be knitted so that there is ample space between the inner surface of the shaft 20 and the outer surface of the rod in the shaft.

The portion under the phanton line of FIG. 1 has been described above as the first embodiment of the invention, this portion may be operated as a single knitting machine without the portion shown above the phantom line, or with the portion shown above the phantom line to become a two needle bed knitting machine, which will be described below as the second embodiment. In this second embodiment, the an upper part of the machine comprises upper machine plate 25B fixedly mounted onto machine truss 10, an upper central hollow shaft 20B, a passive shaft, rotatably supported by upper machine plate 25B, an upper latch needle plate 22B fixed onto the lower end of upper central hollow shaft 20B, a plurality of upper latch needles 23B on the circumference of upper latch needle plate 22B, the upper latch needles 23B being adapted to cooperate with latch needles 23 on the latch needle holder or lower needle plate 22. Cams 26B are provided to enable latch needles 23B to perform the knitting operation. Upper latch needle plate 22B and lower latch needle plate 22 are adapted to rotate synchronously by means of bearing transmission device 30 as shown in FIG. 1, (also in FIGS. 2A and 2B) so that the upper central hollow shaft 20B rotates as a passive revolving shaft with central hollow shaft 20 as an active revolving shaft.

Figure 2A:
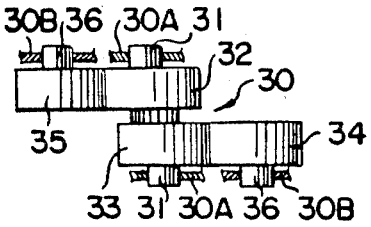
FIG. 2A is a top view of the bearing transmission device of the invention.
Figure 2B:
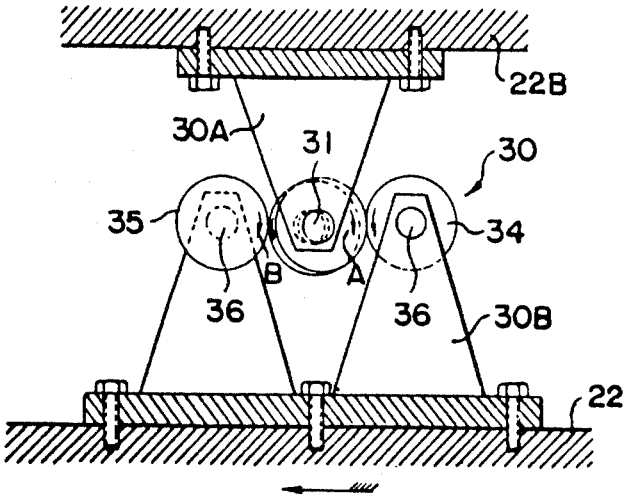
FIG. 2B is a front view of the bearing transmission device of the invention.

As shown in FIGS. 2A and 2B, the bearing transmission device 30 comprises two transmission bearings 32 and 33 respectively rotatably supported by two stationary eccentric axes 31—31 which are integrally formed and are fixed onto upper supporting plate 30A secured onto the bottom surface of said upper latch needle plate 22B. Also as shown, the bearing transmission device 30 further comprises a driving bearing 34 and a braking bearing 35 respectively disposed at both sides of the two transmission bearings 32 and 33, the driving bearing 34 and braking bearing 35 being fixed onto lower supporting plate 30B respectively by means of two axes 36—36. The two axes 36—36 are fixed onto lower supporting plate 30B which is secured onto the surface of circular latch needle plate 22. There is the provision of a small clearance between the transmission bearing 33 and the driving bearing 34 and likewise a small clearance is provided between the transmission bearing 32 and the braking bearing 35. Since the two transmission bearings 32 and 33 are respectively provided on eccentrical axes 31—31, the knitted fabric may pass through the clearances and then go thereunder, during which the two transmission bearings 32–33 are transmitted to rotate thereby (as shown by arrows A and B in FIGS. 2A and 2B). Therefore, in addition to a function for the upper circular latch needle plate 22B and the circular latch needle plate 22 to have synchronous rotation, the transmission bearing device 30 has another function for knitted fabric to pass therethrough. Since the conventional bearing transmission device thereof comprises four sets of driving bearings and one set of braking bearings, five undesirable vertical lines will consequently be brought about. Since two friction forces are generated between the clearances respectively and are exerted on the knitting fabric, only two undesirable vertical lines will occur on the knitted fabric because of the present bearing transmission device, but as the distance between them is small, it requires to insure the beauty of the knitted fabric only that the knitted fabric be cut along the central line between the two vertical lines without losing its beauty because these undesirable vertical lines are near the outer border of the knitted fabric.

Figure 4:
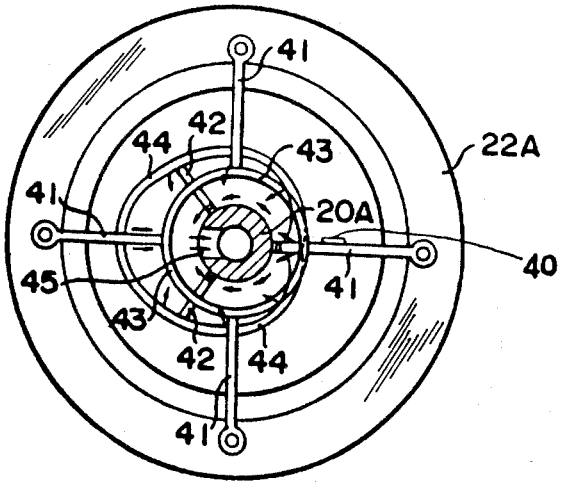
FIG. 4 is a top view depicting the distance adjusting steel rings of the third embodiment of the invention.
Figure 3:
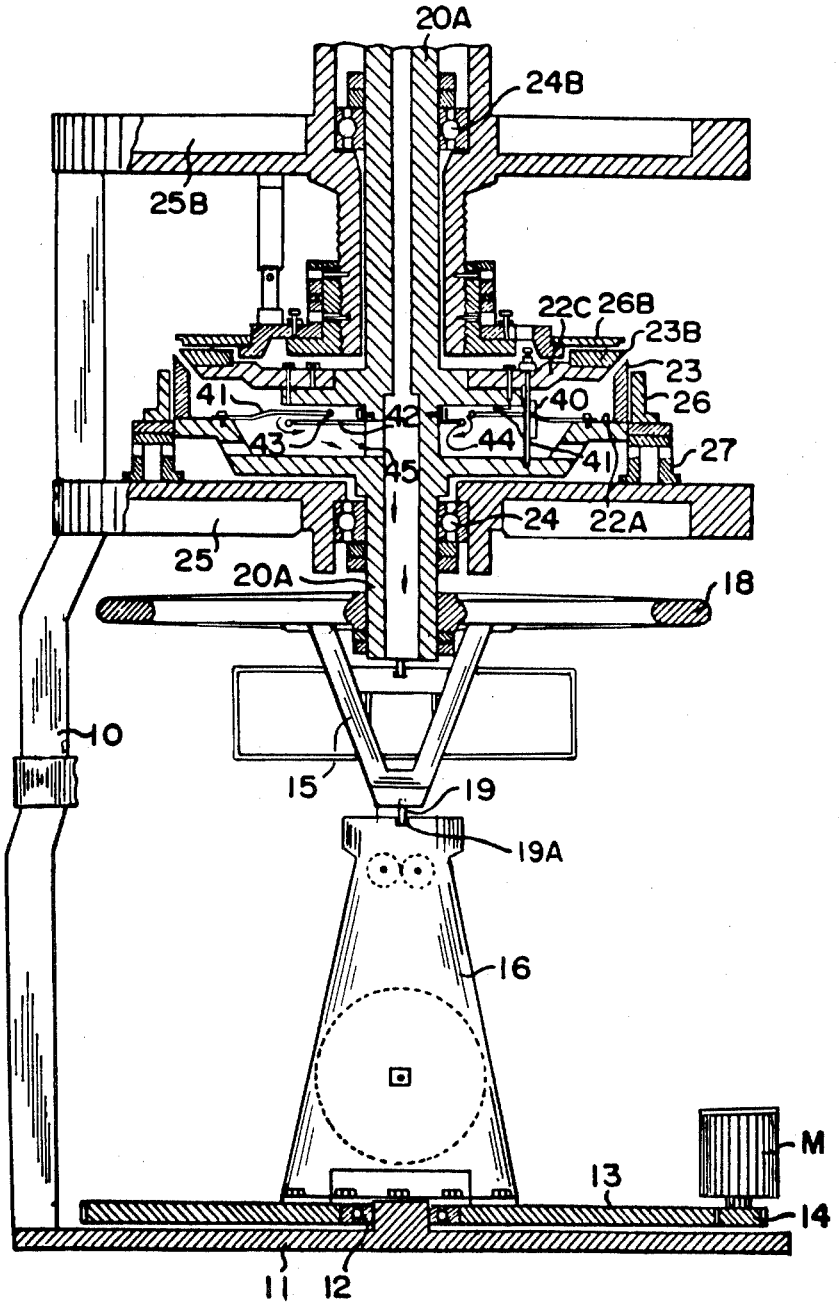
FIG. 3 is a longitudinal cross-sectional view of a third embodiment of the invention.

FIGS. 3 and 4 show a third embodiment of the invention. In this embodiment the circular knitting machine comprises a machine truss 10, a base 11 on which the machine truss 10 is fixedly mounted, an upper machine plate 25B fixedly mounted onto an upper part of machine truss 10, a lower machine plate 25 fixedly mounted to a generally middle portion of machine truss 10, a central hollow shaft 20A having an upper portion rotatably supported by upper machine plate 25B with bearing 24B and a lower portion rotatably supported by lower machine plate 25 with bearing 24, a latch needle holder or a lower latch needle plate 22A integrally formed with central hollow shaft 20A, an upper latch needle plate 22C fixedly mounted on central hollow shaft 20A and disposed above lower latch needle plate 22A, a plurality of latch needles are mounted on needle bed 23B on the circumference of upper latch needle plate 22C, a plurality of latch needles 23 on the circumference of lower latch needle plate 22A, a plurality of cams 26 and 26B adapted to enable latch needles 23 and 23B, respectively, to perform the knitting operation, and cam seats 27. Central hollow shaft 20A is provided with a lower extension on which a transmission ring 18 is fixedly mounted. The transmission ring 18 is provided with an upper driving bracket 15 fixedly mounted onto a lower side thereof, the upper driving bracket 15 being operatively connected to a lower driving bracket 16 which is fixedly mounted onto gear wheel 13, the gear wheel 13 being rotatably mounted onto base 11 with bearing 12 and in mesh with pinion 14 driven by an electric motor M. Pins 19 are adapted to operatively connect upper driving bracket 15 and lower driving bracket 16, the pins 19 having one end fixed to upper driving bracket 15 and another end loosely inserted into a slot 19A formed in lower driving bracket 16 so as to allow self-alignment of the upper and lower driving brackets.

Furthermore, between upper latch needle plate 22C and lower latch needle plate 22A a plurality of supporting bars 42 are secured onto central hollow shaft 20A; at the ends of which lower adjusting steel ring 44 is horizontally secured. Upon said lower latch needle plate 22A a plurality of supporting bars 41 are secured, at the ends of which an upper distance adjusting steel ring 43 is horizontally fixed. The upper distance adjusting steel ring 43, which is a regular circle, and central hollow shaft 20A are concentric, while the lower distance adjusting steel ring 44, is an irregular circle but symmetrical to the supporting bars 41, and eccentric to the hollow shaft. As seen in FIGS. 3 and 4, knife 40 for cutting the knitted fabric is provided between upper circular latch needle plate 22C and lower circular latch needle plate 22A whereby knitted cylinderlike fabric is cut into a flat one. Opposite to knife 40, fabric outlet 45 is provided upon central hollow shaft 20A. In operation, the fabric flows from a knitting position, and afterwards passes along knife 40, to the inner rim of upper ring 43 to the outer rim of lower ring 44, and finally to fabric outlet 45. In order to equalize the strain force on every vertical line of the fabric, namely, the vertical lines between every needle position and fabric outlet which vertical lines are equal in the time of fabric flowing, the lower distance adjusting steel ring 44 is thus constructed with symmetrical supporting bars 41—41 in cooperation with the upper distance adjusting steel ring 43.

To further clarify, as the arrows show in FIGS. 3 and 4, when the knitted fabric is cut by means of knife 40, it will pass forward at equal distances from whatever tangential point of the circumference of the upper distance adjusting steel ring 43 to fabric outlet 45 from which it exits. Since the third embodiment hereof has the provision of the upper and lower latch needle plates secured on one central shaft, they rotate synchronously.

The third embodiment shares the same effect with the first and second embodiments in the damping and counterpoising of oscillation, having the special features that the power transmission distance is lengthened for the purpose of reducing the violent oscillation occurring from the power source, and the oscillation transmitted from any oscillation starting point to the central hollow shaft is radially distributed to each latch needle whereby the occurrence of the undesirable horizontal lines in the knitted fabric is obviated.

Figure 5:
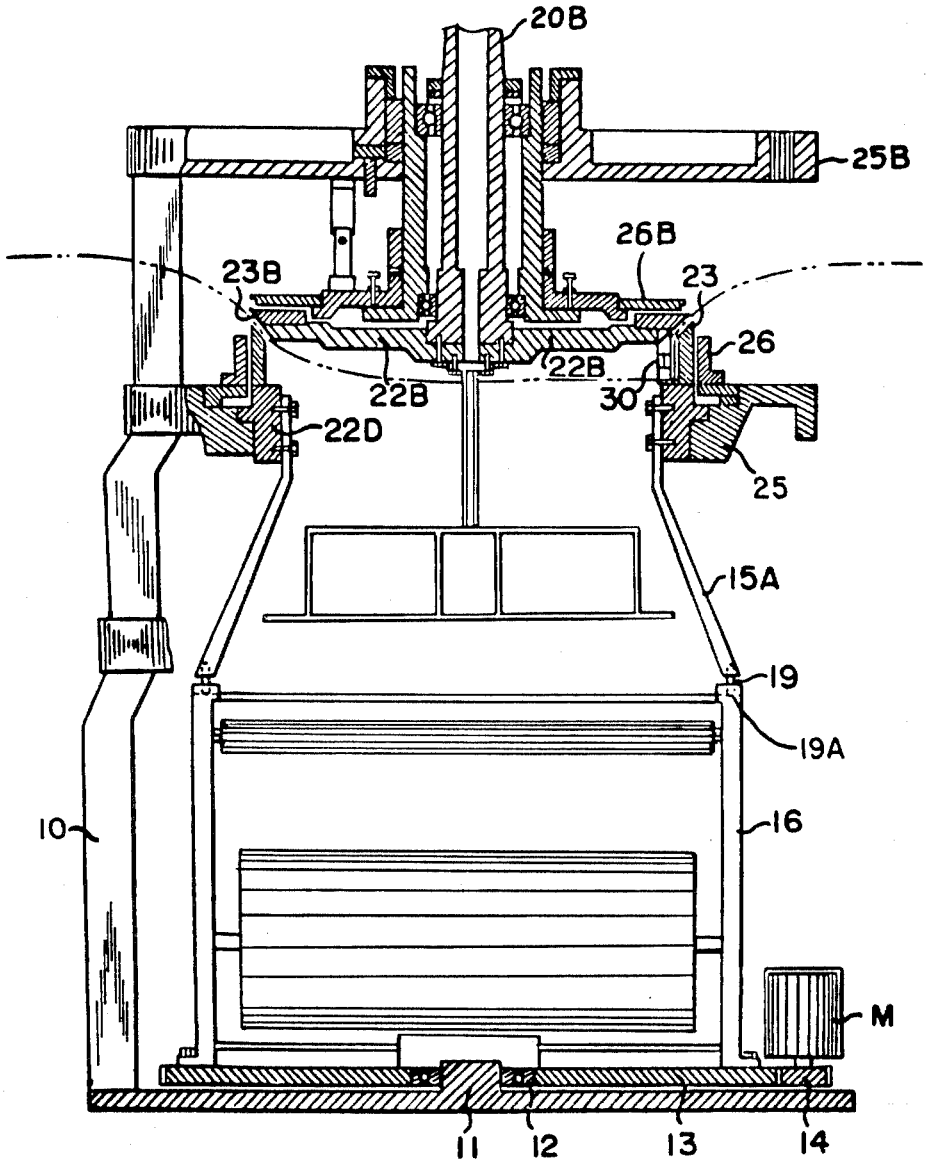
FIG. 5 is a longitudinal cross-sectional view of fourth and fifth embodiments of the invention, wherein the former is the portion under the phantom line, while the latter includes the portions under and above the phantom line.

The portion under the phantom line in FIG. 5 shows a fourth embodiment, which is operable without the portion shown above the phantom line in the drawing as a single circular knitting machine. In the drawing, 22D is latch needle holder or lower latch needle cylinder having a plurality of latch needles 23. A plurality of cams 26 are provided around latch needles 23 to enable the latch needles to perform the knitting operation when lower latch needle cylinder 22D is rotated. The lower latch needle cylinder 22D is provided with upper driving bracket 15A having an upper end fixedly connected thereto, and a lower end operatively connected to lower driving bracket 16 fixedly mounted on gear wheel 13 which is rotatably mounted on base 11 with bearing 12 and in mesh with pinion 14 driven by electric motor M. Upper driving bracket 15A is opperatively connected to lower driving barcket 16 with pins 19 having one end fixed to the upper driving bracket and another end loosely inserted into a slot 19A formed in lower driving bracket 16 so as to allow self-alignment of the upper and lower driving brackets. In this arrangement the oscillation derived by pinion 14 and gear wheel 13 travels a long path to reach the latch needles, and thus the oscillation can be dispersed evenly by the upper and lower driving brackets before it reaches the latch needles and thereby the undesirable horizontal lines may be prevented.

FIG. 5 inclusively of portions under and above the phantom line indicates a fifth embodiment of this invention, which is a two needle bed knitting machine having the arrangement of the fourth embodiment and an upper latch needle plate 22B provided with a plurality of latch needles 23B to cooperate with latch needles 23 of lower latch needle cylinder 22D. Upper latch needle plate 22B is fixedly mounted onto upper central hollow shaft 20B which is rotatably supported by upper machine plate 25B. A bearing transmission device 30, having the same construction and arrangement as that of the first embodiment described above, is provided between the lower latch needle cylinder and the upper latch needle plate whereby lower latch needle cylinder 22D and upper latch needle plate 22B rotate synchronously.

Figure 6:
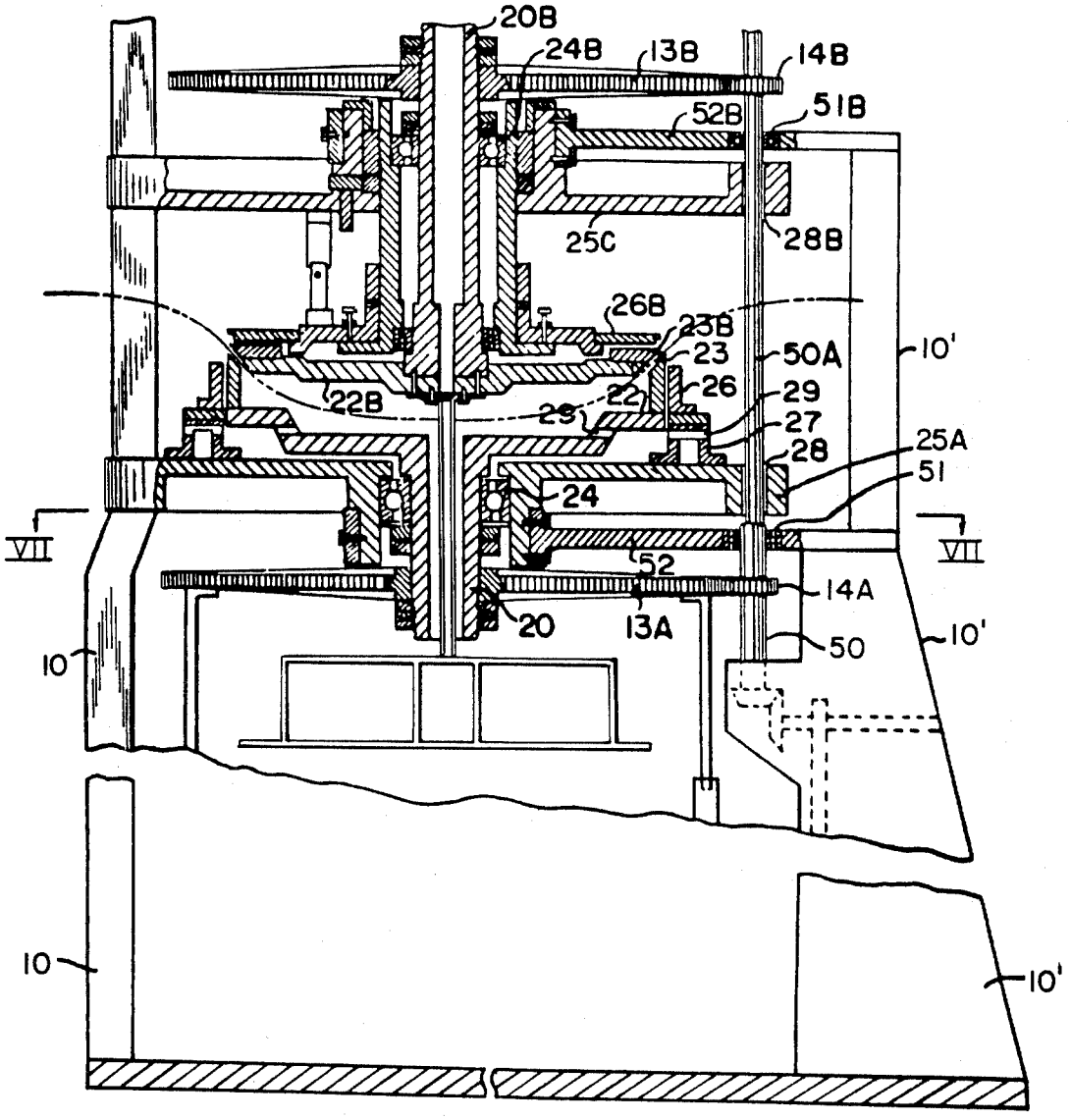
FIG. 6 is a longitudinal cross-sectional view of sixth and seventh embodiments of the invention, wherein the former is the portion under the phantom line, while the latter includes the portions under and above the phantom line, and wherein the base portion is omitted from the drawing.

The portion under the phantom line in FIG. 6 shows a sixth embodiment which is operable as a single knitting machine without the portion shown above the phantom line. The circular knitting machine of this embodiment comprises machine trusses 10 and 10', a base not shown, a lower machine plate 25A fixedly mounted onto machine truss 10, a latch needle holder or lower latch needle plate 22 having a lower central hollow shaft 20 integrally formed therewith, the lower central hollow shaft 20 being rotatably supported by lower machine plate 25A with bearing 24, a lower latch needle plate 22 being provided with a plurality of latch needles 23 on the circumference thereof. A plurality of cams 26 mounted on cam seats 27 are provided around latch needles 23 to enable latch needles 23 to perform the knitting operation when latch needle plate 22 is rotated. A gear wheel 13A is fixedly mounted to a lower end of central hollow shaft 20 to be driven by pinion 14A fixedly mounted on shaft 50 which is driven by an electric motor, not shown. Lower machine plate 25A is provided with a lower damping plate 52 having one end fixed to a hub formed on the lower machine plate 25A, and another end fixed on machine truss 10', and shaft 50 is rotatably supported by lower damping plate 52 by bearing 51.

In this arrangement the rotational driving power is introduced to gear wheel 13A by pinion 14A which is fixedly mounted on shaft 50 driven by a motor, not shown, and thus central hollow shaft 20 and consequently lower latch needle plate 22 are rotated. The oscillation derived from pinion 14A and gear wheel 13A is damped by the oscillation damping plate 52 and evenly dispersed on each latch needle, therefore, the undesirable horizontal lines will not occur on the knitted fabric.

The portion under the phantom line in FIG. 6 as described above as a sixth embodiment may be equipped with the portion shown above the phantom line to become a two needle bed knitting machine, to be referred to as a seventh embodiment of the invention. In addition to the arrangement of the sixth embodiment as described above, the seventh embodiment comprises upper machine plate 25C, an upper central hollow shaft 20C rotatably supported by the upper machine plate 25B, the upper central hollow shaft 20C being provided with a gear wheel 13B fixedly mounted onto its upper end and an upper latch needle plate 22B fixedly mounted onto its lower end, upper latch needle plate 22B having a plurality of latch needles 23B on the circumference thereof to cooperate with latch needles 23 on the lower latch needle plate 22, and a plurality of cams 26B to enable latch needles 23B to perform the knitting operation. Gear wheel 13B is indentical with wheel 13A and is driven by pinion 14B which is identical with pinion 14A. Pinion 14B is fixedly mounted on extension shaft 50A extending from shaft 50, the extension shaft 50A freely passing through hole 28 formed in lower machine plate 25A, a hole 28B formed in upper machine plate 25C, and being rotatably supported by bearing 51B in an upper damping plate 52B having one end fixed to a hub formed on upper machine plate 25C and another end fixed to machine truss 10'. In this arrangement, upper latch needle plate 22B rotates with the upper central hollow shaft which is driven by gear wheel 13B, and gear wheel 13B is driven by pinion 14B which is identical with pinion 14A which drives gear wheel 13A, therefore upper latch needle plate 22B and lower latch needle plate 22 rotate synchronously with each other.

Figure 7:
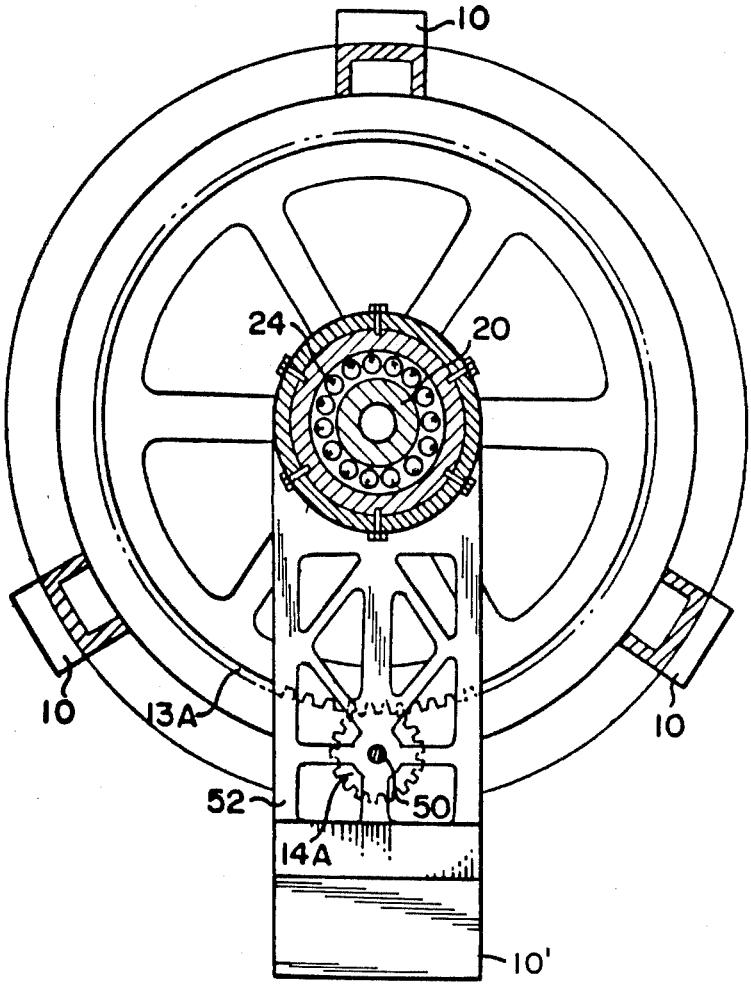
FIG. 7 is a top view of an oscillation damping plate provided in the sixth and seventh embodiments of the invention showing a cross sectional view taken along the section line VII—VII of FIG. 6.

A schematic top view of the sixth and seventh embodiments is shown in FIG. 7.

Figure 8:
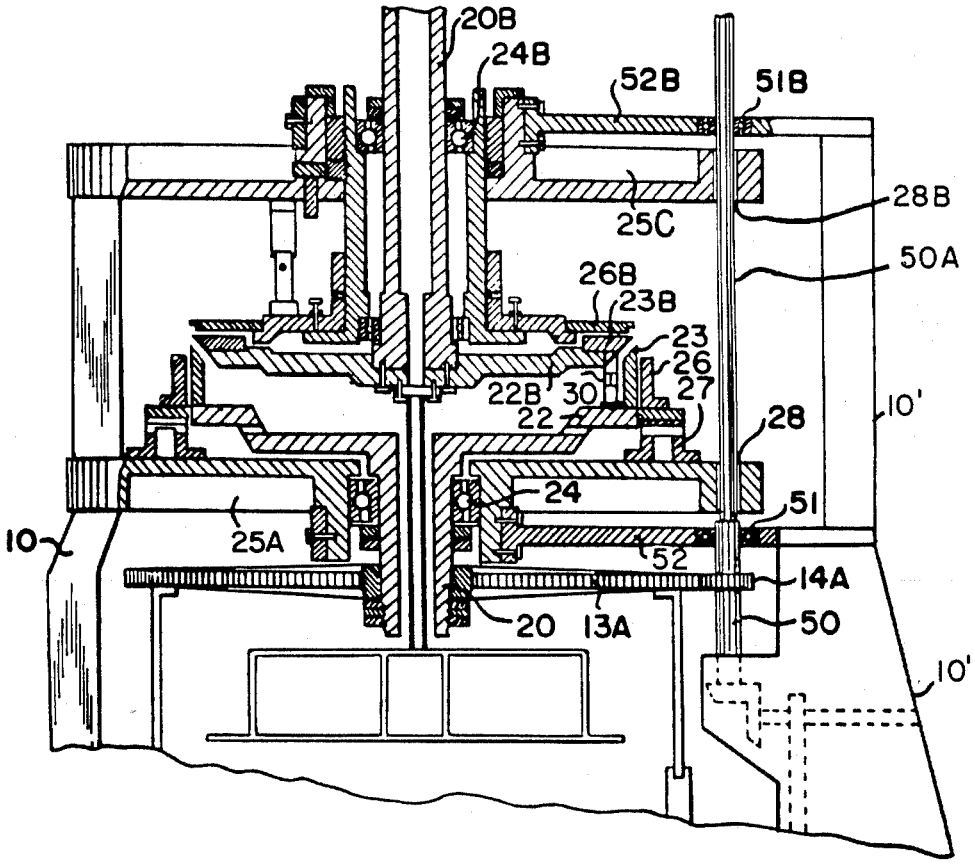
FIG. 8 is a longitudinal cross-sectional view of an eighth embodiment of the invention, with the base portion omitted from the drawing.

FIG. 8 shows an eighth embodiment of the invention. In this embodiment the general construction is the same as the seventh embodiment except that gear wheel 13B and pinion 14B of the seventh embodiment are deleted and the transmission bearing device 30 of the first embodiment is employed instead.

Figure 9:
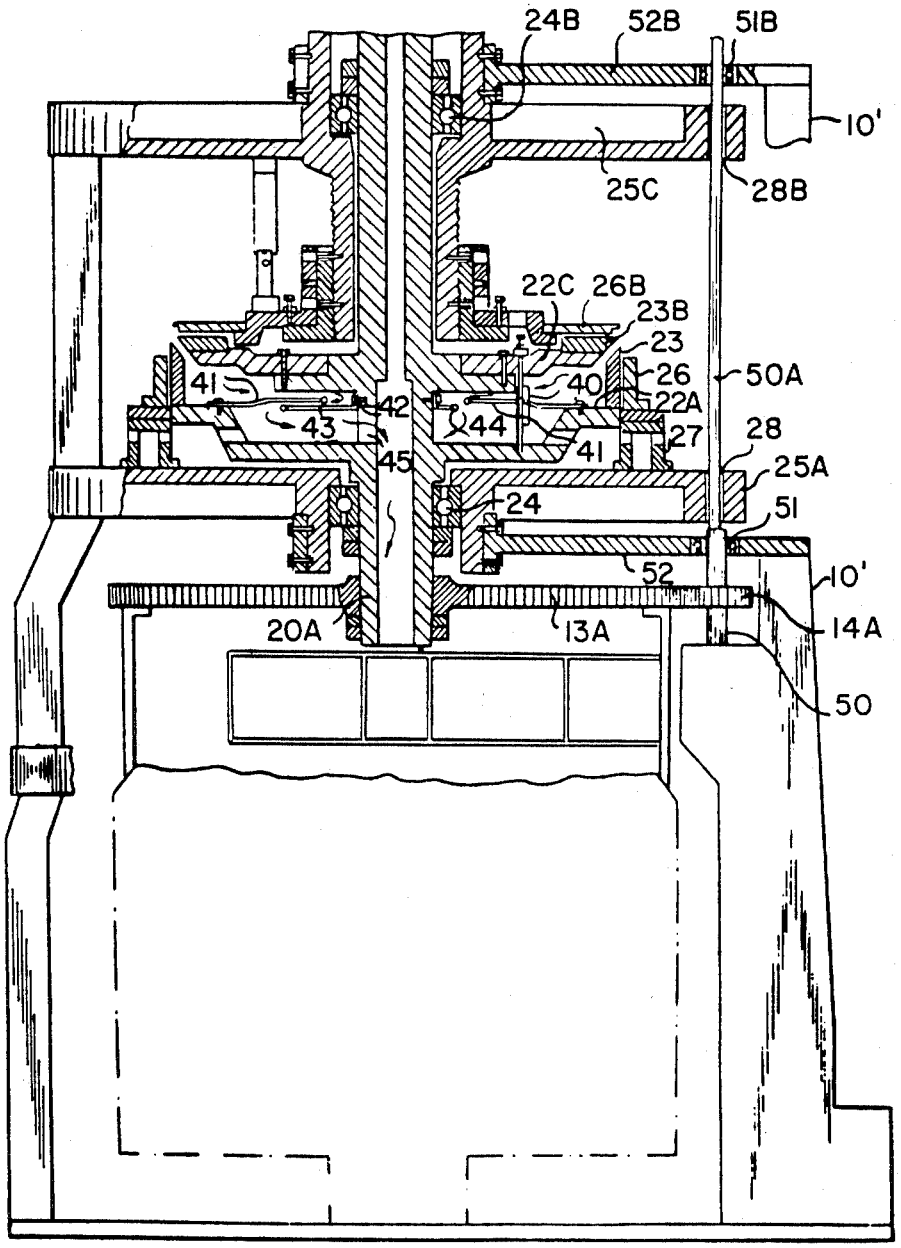
FIG. 9 is a longitudinal cross-sectional view of a ninth embodiment of the invention.

FIG. 9 shows a ninth embodiment of the invention. The circular knitting machine of the embodiment is similar to the third embodiment as shown in FIG. 3, having those members of the third embodiment such as machine truss 10, base 11, upper machine plate 25C, lower machine plate 25A, a central hollow shaft 20A, an upper latch needle plate 22C provided with latch needles 23B, cams 26B, latch needle holder or lower latch needle plate 22A provided with latch needles 23, cams 26, cam seat 27, knife 40, supporting bars 41, 42, upper adjusting ring 43 and lower adjusting ring 44. In addition, this embodiment further comprises gear wheel 13A fixedly mounted onto the lower end of central hollow shaft 20A, pinion 14A in mesh with gear wheel 13A, shaft 50 on which pinion 14A is fixedly mounted, extension shaft 50A extending from shaft 50, upper damping plate 52B having one end fixed to a hub formed on upper machine plate 25C and another end fixed machine truss 10', and lower damping plate 52 having one end fixed on a hub formed on lower machine plate 25A and another end fixed to machine truss 10'. Shaft 50 is driven by an electric motor, not shown, and rotatably supported by lower damping plate 52 with bearing 51. Extension shaft 50A passes through hole 28 formed in lower machine plate 25 and hole 28B formed in upper machine plate 25B and is rotatably supported by damping plate 52B with bearing 51B.

In this arrangement the rotational power is transmitted to central hollow shaft 20A through shaft 50, pinion 14A and gear wheel 13A, and upper and lower latch needle plates 22C and 22A are driven to rotate synchronously. The oscillation derived by gear wheel 13A and pinion 14A is dispersed upon upper and lower damping plates and consequently no horizontal lines will occur on the knitted fabric.

Figure 10:
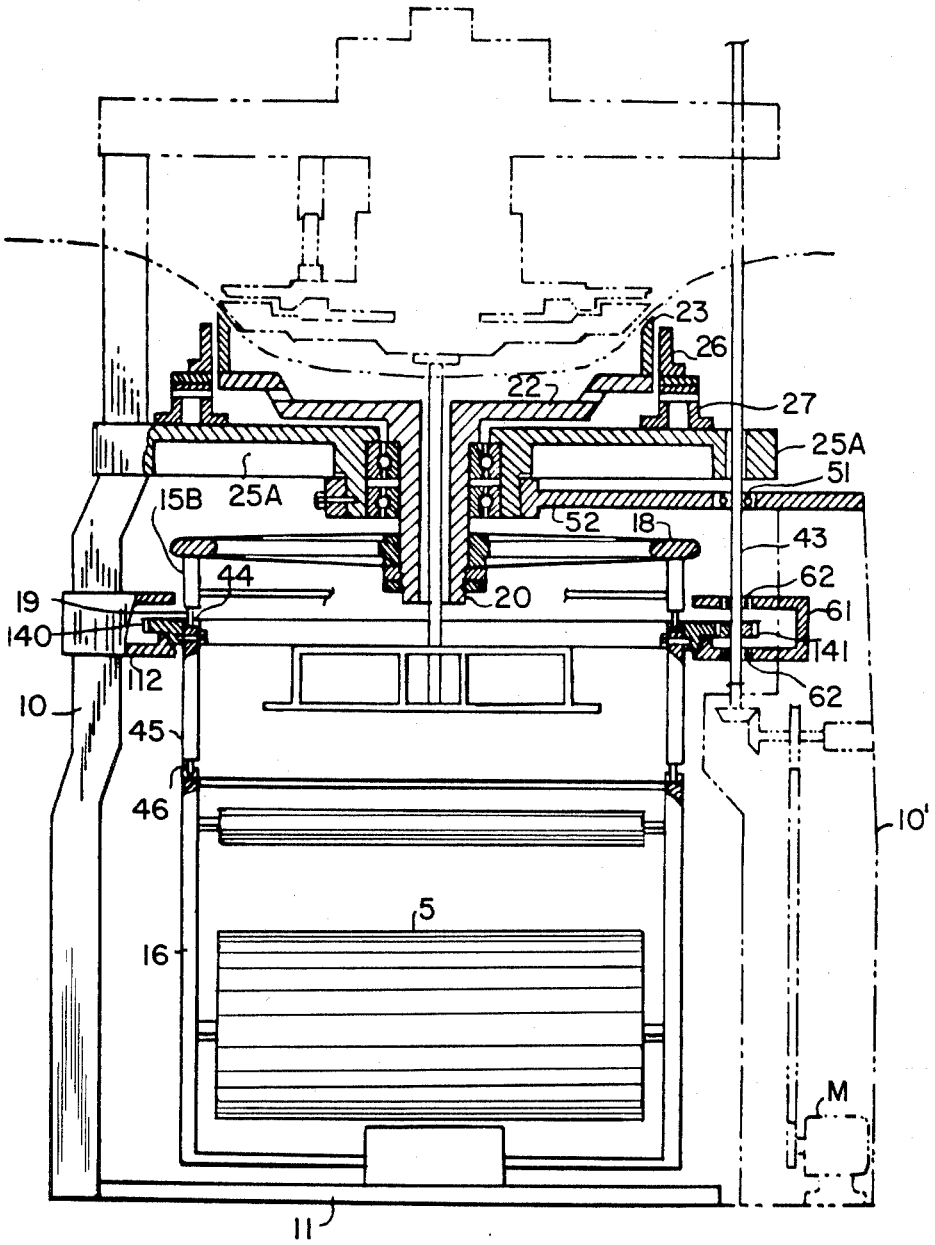
FIG. 10 is a longitudinal cross-sectional view of a tenth embodiment of the invention.

FIG. 10 shows a tenth embodiment of the invention. The circular knitting machine of this embodiment is similar to the first embodiment shown in the lower portion under the phantom line shown in FIG. 1, having those members such as machine truss 10, base 11, a lower machine plate 25A, a latch needle holder or lower latch needle plate 22 provided with central hollow shaft 20 and rotatably supported by lower machine plate 25A, latch needles 23 on lower latch needle plate 22, cams 26, cam seats 27, a transmission ring 18 and an upper driving bracket 15B. This embodiment further comprises an interim driving bracket 45 operatively connected to upper driving bracket 15B with pins 19 having one end fixed to upper driving bracket 15B and another end loosely inserted in slot 44 formed on the upper end of interim driving bracket 45 so as to allow self-alignment of upper and interim driving brackets. Interim driving bracket 45 is provided with ring gear 40 rotatably supported by third machine plate 112 fixedly mounted to machine truss 10, ring gear 140 being in mesh with pinion 141 fixedly mounted on transmission shaft 43 driven by electric motor M. Transmission shaft 43 is rotatably supported with bearing 51 on oscillation damping plate 52 having one end fixed on a hub formed with lower machine plate 25A and another end fixedly mounted on another machine truss 10', and also journaled with bearings 13 on third machine plate 61. In FIG. 10, 16 is a lower bracket operatively connected to interim bracket 45 with pins 46 and rotatably supported by base 11, and 5 is a take up roll rotatably mounted on the lower bracket 16.

In this arrangement the oscillation created by ring gear 40 and pinion 41 at the point of engagement 42 is dispersed and damped by transmission ring 18, third machine plate 61, and also by oscillation damping plate 52, therefore no horizontal lines will occur in the knitted fabric.

Figure 11:
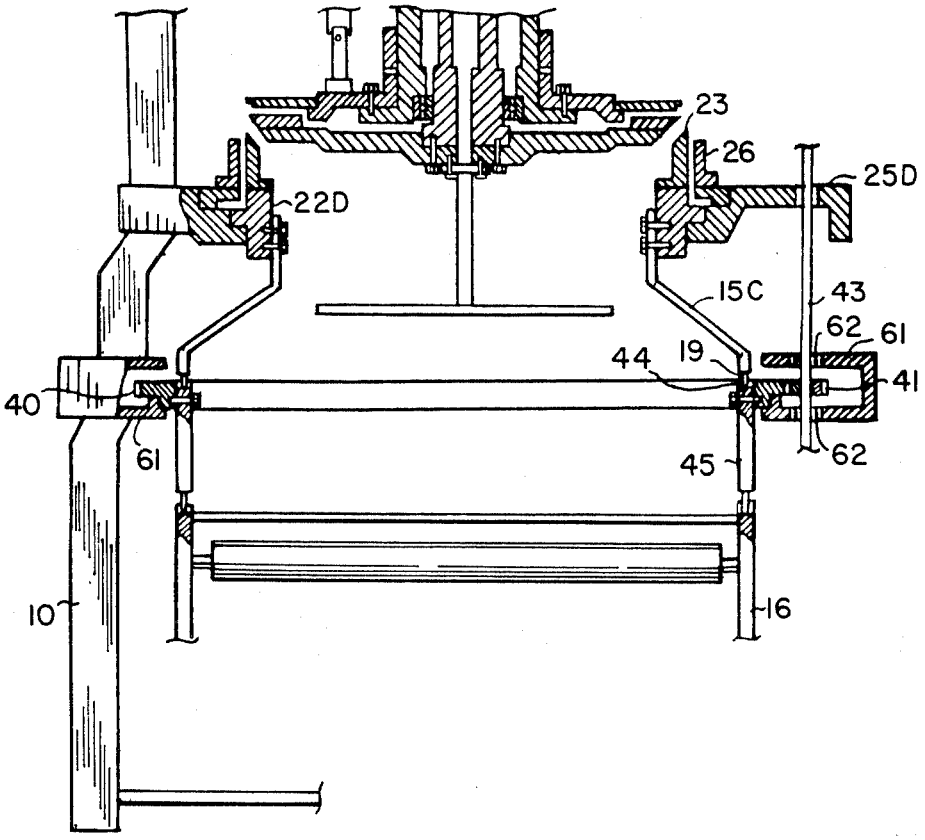
FIG. 11 is a longitudinal cross-sectional view of eleventh embodiment of the invention, with non-essential portions omitted.

FIG. 11 shows the essential portion of an eleventh embodiment of the invention. The circular knitting machine of this embodiment is similar to the fourth embodiment as shown in FIG. 5, having those members of the fourth embodiment such as latch needle holder or latch needle cylinder 22D having a pluraltiy of latch needles 23, cams 26, lower machine plate 25D on which said latch needle cylinder 22D is rotatably supported, and upper driving bracket 15C having an upper end fixedly connected to latch needle cylinder 22D. In addition, this embodiment further comprises an interim driving bracket 45 operatively connected to upper driving bracket 15C with pins 19 having an upper end fixed to upper driving bracket 15C and a lower end loosely inserted into a slot 44 formed on interim driving bracket 45 so as to allow self-alignment of upper driving bracket and interim driving bracket. Interim driving bracket 45 is provided with ring gear 40 fixedly connected thereto, the ring gear 40 being rotatably supported by third machine plate 61 which is fixedly mounted on machine truss 10. Ring gear 40 is in mesh with pinion 41 fixedly mounted onto a transmission shaft 43 rotatably supported by third machine plate 61 with bearings 62 and driven by an electric motor, not shown. In FIG. 11, 16 is a lower bracket operatively connected to interim driving bracket. In this arrangement, the oscillation created by ring gear 40 and pinion 41 is dispersed by third machine plate 61 and upper driving bracket 15C, and therefore the undesirable horizontal lines will not occur on the knitted fabric.

The inventor has made a series of experiments upon embodiments six, seven, eight and nine. Taking a circular latch needle plate of 30 inches in diameter as an example, the results of the experiments indicate that the distance from the starting point of oscillation upon the teeth of the pinion, through the gear wheel 13A, the central hollow shaft 20, the lower circular latch needle plate 22 to the tip of any latch needle is about 1,000 mm, and that the distance extending from the lower bearing 51, through the lower oscillation damping plate 52, the lower cam seat 27, the lower cams 26, to the tip of any latch is also about 1,000 mm. Since the oscillation damping distance of the embodiments six to nine is about 3–5 times that of the conventional art, it is obvious that the oscillation can be greatly decreased and meantime equally dispersed upon any latch needle whereby the undesired horizontal line is effectively prevented.

The oscillation damping distance of the embodiments one, two, three, four, five, ten and eleven is longer than that of the embodiments six, seven, eight and nine. Therefore, the embodiments one–five, ten and eleven have greater effect in oscillation damping and oscillation counterpoising effect.

I claim:

1. An oscillation damping and counterpoising circular knitting machine, comprising;

(a) a base;

(b) a machine truss fixedly mounted on said base;

(c) a first machine plate fixedly mounted on the generally middle portion of said machine truss;

(d) a latch needle holder rotatably supported by said first machine plate, having a circumference on which a plurality of latch needles are provided;

(e) a plurality of cams disposed around said latch needles to enable said latch needles to perform the knitting operation when said latch needle holder is rotated; and (f) a driving means for causing said latch needle holder to rotate, comprising a first bracket member and a second bracket member, said first bracket member being operatively connected to said second bracket member with pin members having one end fixed on said first bracket member and another end loosely inserted into a slot formed on said second bracket member to allow self-alignment of said first bracket member with said second bracket member, and a gear member fixedly connected to said second bracket member, said gear member being driven by a motor driven pinion.

2. An oscillation damping and counterpoising circular knitting machine as recited in claim 1, wherein:

(a) said latch needle holder is a plate having a first central hollow shaft integrally formed therewith, said first central hollow shaft having a lower end on which a transmission ring is fixedly mounted;

(b) said first bracket member is fixedly connected to said transmission ring;

(c) said gear member is a gear wheel rotatably supported by said base.

3. An oscillation damping and counterpoising circular knitting machine as recited in claim 1, wherein:

(a) said latch needle holder is a plate having a first central hollow shaft integrally formed therewith, said first central hollow shaft having a lower end on which a transmission ring is fixedly mounted;

(b) said first bracket member is fixedly connected to said transmission ring;

(c) said gear member is a ring gear rotatably supported by a third machine plate fixedly mounted on said machine truss and disposed below said first machine plate; and (d) said pinion is fixedly mounted onto a shaft driven by an electric motor, said shaft being rotatably supported by said third machine plate and also by a damping plate having one end fixed on a hub formed on said machine plate and another end fixedly supported by another machine truss.

4. A oscillation damping and counterpoising circular knitting machine as recited in claim 1, wherein:

(a) said latch needle holder is a hollow cylinder and said dirst bracket member is fixedly connected to said hollow cylinder;

(b) said gear member is a gear wheel rotatably supported by said base; and (c) said second bracket member is fixedly mounted onto said gear wheel.

5. An oscillation damping and counterpoising circular knitting machine as recited in claim 1, wherein:

(a) said latch needle holder is a hollow cylinder and said first bracket member is fixedly connected to said hollow cylinder;

(b) siad gear member is a ring gear rotatably supported by a third machine plate fixedly mounted on said machine truss and disposed below said first machine plate; and (c) said pinion is fixedly mounted on a shaft driven by an electric motor, said shaft being rotatably supported by said third machine plate.

6. An ocillation damping and counterpoising circular knitting machine as recited in claim 2, further comprising:

(a) a second machine plate fixedly mounted on an upper portion of said machine truss;

(b) a second central hollow shaft integrally combined with said first central hollow shaft and rotatably supported by said second machine plate, having a hollow interior; p1 (c) an upper latch needle plate fixedly mounted on said second central hollow shaft and disposed above said latch needle holder, said upper latch needle plate having a circumference provided with a plurality of upper latch needles to cooperate with the latch needles on said latch needle holder;

(d) a plurality of cams disposed around the upper latch needles on said upper latch needle plate to enable said upper latch needles to perform the knitting operation when said upper latch needle plate is rotated; and (e) a knife provided in between said upper latch needle plate and said latch needle holder for cutting the knitted fabric;

wherein said second central hollow shaft is provided with an opening formed between said upper latch needle plate and said latch needle holder, said opening being adapted to allow the knitted fabric cut by said knife to flow into the hollow interior of said second central hollow shaft.

* * * * *